US006972408B1

(12) United States Patent
Reilly

(10) Patent No.: US 6,972,408 B1
(45) Date of Patent: Dec. 6, 2005

(54) ULTRA HIGH MASS RANGE MASS SPECTROMETER SYSTEMS

(75) Inventor: Peter T. A. Reilly, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 49 days.

(21) Appl. No.: 10/955,302

(22) Filed: Sep. 30, 2004

(51) Int. Cl.[7] ..... H01J 41/04

(52) U.S. Cl. ..... 250/292; 250/288; 250/251; 250/281; 250/282; 55/318; 73/28.04

(58) Field of Search ..... 250/293, 288, 250/251, 281, 282; 55/318; 73/28.04

(56) References Cited

U.S. PATENT DOCUMENTS

2002/0166961 A1 * 11/2002 Berggren et al. ..... 250/288

OTHER PUBLICATIONS

J. Allen and R. K. Gould, "Mass spectrometric analyzer for individual aerosol particles," Review of Scientific Instruments, 1981, pp. 804-809, vol. 52, Issue 6.

M.P. Sinha, et al., Particle analysis by mass spectrometry, Journal of Colloid and Interface Science, 1982, pp. 140-153,vol. 87, No. 1.

Y. Cai, et al., "Ion trap mass spectrometry of fluorescently labeled nanoparticles," Analytical Chemistry, 2003, pp. 1805-1811, vol. 75, No. 8.

J.D. Allan, et al., "Correction to Quantitavie sampling using Aerodyne aerosol mass . . . 1 . . . ," Journal of Geophysical Research-Atmospheres, 2003, pp. 4283-4283, vol. 108, No. D9.

J.D. Allan, et al., "Correction to Quantitavie sampling using Aerodyne aerosol mass . . . 2 . . . ," Journal of Geophysical Research-Atmospheres, 2003, pp. 4284-4284, vol. 108, No. D9.

J.D. Allan, et al., "Quantitative sampling using an Aerodyne Aerosol mass . . . 1 . . . ," Journal of Geophysical Research-Atmospheres, 2003, pp. 4090-4090, vol. 108, No. D3.

J.D. Allan, et al., "Quantitative sampling using an Aerodyne Aerosol mass . . . 2 . . . ," Journal of Geophysical Research-Atmospheres, 2003, pp. 4091-4091, vol. 108, No. D3.

J.L. Jimenez, et al., "Ambient aerosol sampling using Aerodyne Aerosol Mass Spectrometry," Journal of Geophysical Research-Atmospheres, 2003, pp. 8425-8425, vol. 108, No. D7.

A. Lazar, et. al, "Real-Time Surface Analysis of Individual Airborne Environmental Particles," Environmental Science and Technology, 1999, pp. 3993-4001, vol. 33, No. 22.

(Continued)

*Primary Examiner*—Nikita Wells
*Assistant Examiner*—Zia R. Hashmi
(74) *Attorney, Agent, or Firm*—Judson R. Hightower

(57) ABSTRACT

Applicant's present invention comprises mass spectrometer systems that operate in a mass range from 1 to $10^{16}$ DA. The mass spectrometer system comprising an inlet system comprising an aerodynamic lens system, a reverse jet being a gas flux generated in an annulus moving in a reverse direction and a multipole ion guide; a digital ion trap; and a thermal vaporization/ionization detector system. Applicant's present invention further comprises a quadrupole mass spectrometer system comprising an inlet system having a quadrupole mass filter and a thermal vaporization/ionization detector system. Applicant's present invention further comprises an inlet system for use with a mass spectrometer system, a method for slowing energetic particles using an inlet system. Applicant's present invention also comprises a detector device and a method for detecting high mass charged particles.

14 Claims, 9 Drawing Sheets

OTHER PUBLICATIONS

O.Y. Zheng, et al., "Character. of a serial array of miniature cylindrical ion trap mass analyzers," Rapid Comm. Mass Spectrometry, 1999, pp. 2444-2449, vol. 13, Issue 24.
R.E. March, et al, "Quadrupole Storage Mass Spectrometry," Chemical Anal Series, 1989, Chapter 2,pp 31-110, vol. 102, Wiley and Sons, New York.
Internal Appl. No. PCT.GB01/05264—International Publication No. WO 02/50886, 2002.
Baron and Willeke, "Gas and Particle Motion," Aerosol Measurement: Principles, Techniques and Applications, 1993, pp. 23-40, Wiley and Sons, New York.
P. Liu, et al., "Generating Particle Beams of Controlled Dimensions and Divergence. 2. Experimental Evaluation . . . ," Aerosol Science and Tech., 1995, pp 314-324, vol. 22.
P. Liu, et al., "Generating Particle Bemas of Controlled Dimensions and Divergence.1. Theory of Particle Motion . . . ," Aerosol Science and Tech., 1995, pp. 293-313, vol. 22.
J.T. Jayne, et al., Development of an aerosol mass spectrometer for size and composition analysis of submicron particles, Aerosol Sci & Tech, 2000, pp. 49-70, vol. 33.
R.V. Mallina, et al., "High speed particle beam generation: A dynamic focusing mechanism for slecting ultrafine particles," Aerosol Sci & Tech, 2000, pp. 87-104, vol. 33.
G.A. Petrucci, et al., "A differentially pumped particle inlet for sampling of atmospheric aerosols into a time-of-flight . . . ," Aerosol Sci & Tech, 2000, pp. 105-121, vol., 33.
H.J. Tobias, et al., "Real-time chem. anal. of organic aerosols using a thermal desorption particle beam mass spectrometer," Aerosol Sci and Tech, 2000, pp. 170-190, vol. 33.
D.B. Kane, et al., "An electrostatic lens for focusing charged particles in a mass spectrometer," Aeriosol Science and Technology, 2001, pp. 990-997, vol. 35.
B.E. Wilcox, et al., "Improved ion extraction from a linear octopole ion tap: SIMON . . . ," J of the Am Soc for Mass Spectrometry, 2002, pp. 1304-1312, vol. 13.
A.V. Tomachev, et al., "A collisional focusing ion guide for . . . ," Nuc Inst & Methods in Phys Res Sect B-Beam Interactions with Mat and Atoms, 1997, pp 112-119, vol. 124.
V.V. Razniko, et al., "Ion rotating motion in a gas-filled radio-frequency quadrupole ion guide . . . ," Rapid Comm in Mass Spectrometry, 2001, pp. 1912-1921, vol. 15.
R.F. Wuerker, et al., "Electrodynamic containment of charged particles," Journal of applied Physics, 1959 pp. 342-349, vol. 30.
M. Yang, et al., "Laser Desorption Tandem Mass spectrometry of Individual Microparticles in an Ion Trap Mass Spectrometer," Anal Chem, 1995, pp. 4330-4334, vol. 67.
L. Ding, et al., Rectangular Wave Quadrupole field and Digital Q(IT)MS Technology, 49th Am Soc for Mass Spectrometry Conf on Mass Spectrometry and Applied Topics, 2001.
L. Ding, et al., "A simulation study of the digital ion trap mass spectrometer," International Jouranl of Mass Spectrometry, 2002, pp. 117-138, vol. 221.
S.K. Sze, et al., "Plasma electron capture characterization of large dissociation for the proteins by top down mass spectrometry," Analyt Chem, 2003, pp. 1599-1603, vol. 75.
Y. Ge, et al., "Top down characterization of larger proteins (45 kDa) by electron cpature dissociation mass spectrometry," J of the Am Chem Soc, 2002, pp. 672-678, vol. 124.
F.W. McLafferty, "Tandem mass spectrometric analysis of compklex biological mixtures," International Jouranl of Mass Spectrometry, 2001, pp. 81-87, vol. 212.
N.L. Kelleher, et al., "Top down versus bottom up protein characterization by tandem high-resolution mass spectrometry," J of the Am Chem Soc, 1999, pp. 806-812, vol. 121.
W. Gabryelski and L. Li, "Photoinduced dissociation of electrospray-generated ions in an ion trap/time-of-flight . . . ," Rapid Comm in Mass Spect, 2002, pp. 1805-1 811, vol. 16.
B.J. Goolsby and J.S. Brodbelt, "Tandem infrared multiphoton dissociation and collisionally activated dissociation technique in a . . . ," Anal Chem, 2001, pp 1270-1276, vol. 73.
A.H. Payne and G.L. Glish, "Thermmally assisted infrared multiphoton photodissociation in a quadrupole ion trap," Anal Chem, pp. 3542-3548, vol. 73.
Y. Ge, et al., "Blackbody infrared radiative dissociation of larger (42 kDa) multipl.e charged proteins," Intern J of Mass Spect, 2001, pp. 203-214, vol. 210.
Y. Hashimoto, et al., "Collision-activated infrared multiphoton dissociation in a quadrupole ion trap mass spectrometer," Analyt Chem, pp. 420-425, vol. 75.
P.T.A. Reilly, et al., "Modification of an ion trap for real-time trapping of nanoparticles . . . ," 49th Am Soc for Mass Spect Conf on Mass Spect and Appl Topics, Chicago, 2001.
S.A. McLuckey, et al., Ion/ion proton-transfer kinetics: implicaitons for analysis of ions derived from electrospray of protein mix, Anal Chem, 1998, pp. 1198-1202, vol. 70.
J.L. Stephenson and S.A. McLuckey, "Charge reduct of oligonuc leotide anions via gas-phase electron transfer . . . ," Rapid Comm in Mass Spect, 1997, pp. 875-880, vol. 11.
B. King and D.A. Brian, "Bovine Coronavirus Structural Proteins," J of Virology, 1982, pp. 700-707, vol. 42.
Y. Cai, et al, "Single-Particle Mass Spectrometry of Polystyrene Microspheres and Diamon," Analytical Chem, 2001.

* cited by examiner

ULTRA HIGH MASS RANGE MASS SPECTROMETER SYSTEMS

The United States government has rights in this invention pursuant to contract no. DE-AC05-00OR22725 between the United States Department of Energy and UT-Battelle, LLC.

FIELD OF THE INVENTION

The present invention relates to the field of mass spectrometry, particularly relating to a mass spectrometer system that operates in an unlimited mass range including the ultra high mass range of greater than 100 kDa.

BACKGROUND OF THE INVENTION

There is very little mass spectrometry performed in the ultra high mass range (>100 kDa). Electrospray ionization and matrix assisted laser desorption ionization were Nobel Prize-winning ideas that enabled mass spectrometry beyond 1000 Da. This accomplishment sparked a revolution in biomedical science, the ramifications of which are still being felt almost two decades later.

There are three fundamental problems associated with mass spectrometry of ultra high mass species. The first problem involves removal of the enormous amount of kinetic energy imparted to the high mass species in moving them from atmospheric pressure or a condensed matrix into vacuum during the ionization/vaporization process. The second problem is that most mass analyzers are not designed or are physically incapable of working in the ultra high mass range, mass-to-charge ratio>100 kDa. Thirdly, there is a problem with detecting the analytes as they are ejected from the trap over the entire mass range. Detection efficiency decreases with increasing mass above approximately $10^4$ Da.

OBJECTS OF THE INVENTION

Accordingly, it is an object of the present invention to provide a mass spectrometer system that is capable of operating in an ultra high mass range above 100 KDa.

It is another object of the present invention to provide a mass spectrometer system that permits real-time analysis of viruses, whole DNA and RNA, whole bacteria, pollen and other ultra high mass species.

It is yet another object of the present invention to provide a kinetic energy reducing inlet to be used with a mass spectrometer system that permits the delivery of extremely high mass charged species into vacuum with near zero translational kinetic energies.

It is still yet another object of the present invention to provide an ion trap mass spectrometer system that operates in a mass range of $1–10^{16}$ Da.

It is a further object of the present invention to provide an ion trap mass spectrometer system that operates in an essentially infinite mass range that is capable of performing tandem mass spectrometry.

It is yet a further object of the present invention to provide a detector to be used with a mass spectrometer system that permits the detection of extremely high mass charged species as they are expelled from an ion trap mass spectrometer and that operates in a mass range from 1 to $10^{16}$ DA.

These and other objects, features and advantages of the present invention will become apparent after a review of the following detailed description of the disclosed embodiments and the appended claims.

SUMMARY OF THE INVENTION

In accordance with one aspect of the present invention, the foregoing and other objects are achieved by a mass spectrometer system comprising an inlet system comprising an aerodynamic lens system for collimating particles of charged species into a beam wherein the aerodynamic lens system has a series of lenses of axially symmetric contractions and enlargements, a reverse jet for slowing the particles aerodynamically to near zero kinetic energy, and a multipole ion guide having end caps and is a variable frequency ion guide with a digitally produced potential. The multipole ion guide operates in a buffer gas to trap the particles at any mass-to-charge ratio and delivers the particles on demand. The reverse jet sits in a vacuum chamber in line with the axis of the collimated beam of particles. The reverse jet is coupled to the aerodynamic lens system and the multipole ion guide, the reverse jet being a gas flux generated in an annulus centered on the axis of the collimated beam of particles and propagating in the opposite direction of the beam of particles. The reverse jet has an opening through the center of the reverse jet wherein the collimated beam of particles delivered from the aerodynamic lens system passes through the center of the reverse jet wherein as the gas flux through the annulus is increased, the expansion from the annulus moves in a reverse direction forming the jet of gas in the reverse direction, wherein the gas flux through the reverse jet being adjustable to decrease the forward velocity of the beam of particles while permitting passage through the center of the annulus. The multipole ion guide is coupled to the reverse jet within the vacuum chamber and in line with the axis of the collimated beam of particles, wherein the pressure in the vacuum chamber being adjustable to further slow and enable trapping of the particles in the multipole ion guide by application of a potential to the end caps of the multipole wherein the end cap potential is adjustable to permit on-demand delivery of the trapped charged particles. The mass spectrometer system further comprises a digital ion trap that permits instantaneous changes in the trapping potential frequency so that any mass-to-charge ratio ion can be stored, excited or ejected. The mass spectrometer system further comprises a thermal vaporization/ionization detector system comprising a vaporization/ionization chamber for receiving the beam of charged particles, a vaporization means for thermally inducing vaporization and fragmentation of the charged particles housed within the vaporization/ionization chamber, an ionization means for ionizing the vapors from the charged particles housed within the vaporization/ionization chamber wherein the ionization means is normal to the axis of the beam of charged particles, and a detection component for detecting the charged species from the vaporized particles, wherein the ionization means is normal to the axis of the detection component.

In accordance with another aspect of the present invention, other objects are achieved by a quadrupole mass spectrometer comprising an inlet system comprising an aerodynamic lens system for collimating particles of charged species into a beam wherein the aerodynamic lens system has a series of lenses of axially symmetric contractions and enlargements, a reverse jet for slowing the particles aerodynamically to near zero kinetic energy, and a quadrupole mass filter having end caps and is a variable frequency ion guide with a digitally produced potential. The quadrupole mass filter operates in a buffer gas to trap the particles at any mass-to-charge ratio and delivers the particles on demand. The reverse jet sits in a vacuum chamber in line with the axis of the collimated beam of particles and is coupled to the aerodynamic lens system and the quadrupole mass filter. The reverse jet is a gas flux generated in an annulus centered on the axis of the collimated beam of particles and propagating in the opposite direction of the beam of particles. The reverse jet has an opening through the center of the reverse jet wherein the collimated beam of particles delivered from the aerodynamic lens system passes through the center of the reverse jet wherein as the gas flux through the annulus is increased, the expansion from the annulus moves in a reverse direction forming the jet of gas in the reverse direction, wherein the gas flux through the reverse jet being adjustable to decrease the forward velocity of the beam of particles while permitting passage through the center of the annulus. The quadrupole mass filter is coupled to the reverse jet within the vacuum chamber and in line with the axis of the collimated beam of particles, wherein the pressure in the vacuum chamber being adjustable to further slow and enable trapping of the particles in the quadrupole mass filter by application of a potential to the end caps of the quadrupole mass filter wherein the end cap potential is adjustable to permit on-demand delivery of the trapped charged particles. The mass spectrometer system further comprises a thermal vaporization/ionization detector system comprising a vaporization/ionization chamber for receiving the beam of charged particles, a vaporization means for thermally inducing vaporization and fragmentation of the charged particles housed within the vaporization/ionization chamber, an ionization means for ionizing the vapors from the charged particles housed within the vaporization/ionization chamber wherein the ionization means is normal to the axis of the beam of charged particles, and a detection component for detecting the charged species from the vaporized particles, wherein the ionization means is normal to the axis of the detection component.

In accordance with yet another aspect of the present invention, other objects are achieved by an inlet system for use with a mass spectrometer system comprising an aerodynamic lens system for collimating particles into a beam comprising a series of lenses of axially symmetric contractions and enlargements, a reverse jet for slowing the particles of charged species aerodynamically to near zero kinetic energy at any mass-to-charge ratio and delivering the charged particles on demand, wherein the reverse jet sites in a vacuum chamber in line with the axis of the collimated beam of particles. The reverse jet is coupled to the aerodynamic lens system and is a gas flux generated in an annulus centered on the axis of the collimated beam of particles and propagating in the opposite direction of the beam of particles. The reverse jet has an opening through the cent of the reverse jet wherein the collimated beam of particles delivered from the aerodynamic lens system passes through the center of the reverse jet wherein as the gas flux through the annulus is increased, the expansion from the annulus moves in a reverse direction forming a jet of gas in the reverse direction, wherein the gas flux through the reverse jet is adjustable to decrease the forward velocity of the beam of particles while permitting passage through the center of the annulus. The inlet system further comprises a multipole ion guide having end caps and is a variable frequency ion guide with a digitally produced potential wherein the multipole ion guide is coupled to the reverse jet within the vacuum chamber and is in line with the axis of the collimated beam of particles, wherein the pressure in the vacuum chamber is adjustable to further slow and enable trapping of the particles in the multipole ion guide by application of a potential to the end caps of the multipole ion guide wherein the end cap potential is adjustable to permit on-demand delivery of the trapped charged particles.

In accordance with a further aspect of the present invention, other objects are achieved by a method for slowing energetic particles using an inlet system comprising an aerodynamic lens system for collimating particles into a beam, comprising a series of lenses of axially symmetric contractions and enlargements and a multipole ion guide having end caps and is a variable frequency ion guide with a digitally produced potential wherein the multipole ion guide operates in a buffer gas to trap the particles of charged species at any mass-to-charge ratio and delivers the particles on demand. The multipole ion guide is coupled to the aerodynamic lens system within a vacuum chamber wherein the pressure in the vacuum chamber is adjustable to further slow and enable trapping of the particles in the multipole ion guide by application of a potential to the end caps of the multipole ion guide wherein the end cap potential is adjustable to permit on-demand delivery of the trapped charged particles. The method comprises the steps of passing a beam of particles through an aerodynamic lens system to collimate the particles into a beam wherein the particles acquire translational energy upon exiting the aerodynamic lens system, and delivering the beam of particles into a multipole ion guide having a defined length and operating pressure to slow particles to a stop inside the multipole ion guide by collisions with the buffer gas to be trapped and delivered on demand.

In accordance with yet another aspect of the present invention, other objects are achieved by a detector device for the detection of charged particles comprising a vaporization/ionization chamber for receiving a beam of charged particles, a vaporization means for thermally inducing vaporization and fragmentation of the charged particles housed within the vaporization/ionization chamber, an ionization means for ionizing the vapors from the charged particles housed within the vaporization/ionization chamber wherein the ionization means is normal to the axis of the beam of charged particles, and a detection component for detecting the charged particles wherein the ionization means is normal to the axis of the detection component.

In accordance with still yet a further aspect of the present invention, other objects of the present invention are achieved by a method for detecting high mass charged particles comprising the steps of focusing a beam of charged particles into a detector device, vaporizing the charged particles within the detector device by heating the charged particles to a temperature greater than 1000° C. wherein a vapor of relatively low mass charged and fragmented species from the charged particles is formed, ionizing the vaporized and fragmented low mass species from the charged particles to positively charged ions, and detecting the low-mass positive ions using a detection component.

Figure 1:
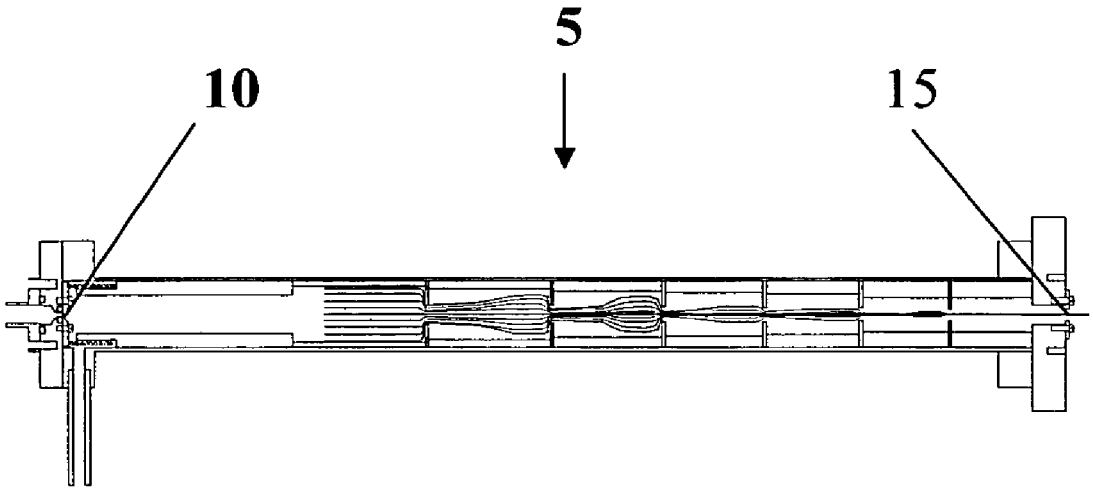
FIG. 1 is an illustration of an aerodynamic lens system.

For a better understanding of the present invention, together with other and further objects, advantages and capabilities thereof, reference is made to the following disclosure and appended claims in connection with the above-described drawings.

DETAILED DESCRIPTION OF THE INVENTION

Applicant's invention disclosed and claimed herein is a mass spectrometer system capable of operating in an essentially infinite mass range ($1–10^{16}$ Da). The instrument of the present invention is ion trap based and can trap, isolate, excite, eject and detect any mass in the given range, thereby permitting tandem mass spectrometry over the entire range. The design of Applicant's present invention solves the three fundamental problems, previously discussed, that are associated with mass spectrometry of ultra high mass species. The instrument of the present invention permits real-time analysis of viruses, whole DNA and RNA, whole bacterial and pollen as well as other ultra high mass species. The entire range of ambient particles is also accessible.

The ability to perform mass spectrometry in the high mass range above 100 KDa is a new frontier in mass spectrometry that will enable new technologies and methodologies to develop. Current methodologies in bioanalytical mass spectrometry are all designed around the mass limitations of the current techniques. Samples have to undergo tedious separations to remove unwanted material that will interfere with the analysis. Large proteins, DNA and RNA have to be broken apart for mass analysis. With Applicant's present invention, such large species can be vaporized and ionized by electrospray ionization directly admitted into the inlet, trapped and mass analyzed to indicate its presence. However, the analysis does not end there. The analyte can then be precisely mass isolated and subjected to any combination of the following tandem mass spectrometry techniques, including electron capture dissociation (ECD) or electron transfer dissociation (ETD), photodissociation (PD) and collision-induced dissociation (CID). These tandem mass spectrometry techniques can be applied over and over again to provide sequence information or just a positive identification because the frequency of the potential can be instantaneously changed to optimize the psuedopotential well for the analyte ion of interest.

The ability to measure mass spectra above 100 KDa opens up new frontiers in biomedical science. Protein expression and analysis suddenly becomes much less cumbersome and much more rapid. Analysis of viruses is one area that will change tremendously with the technology. Generally, to find out if a person is infected with a particular virus, antibody analyses are performed. This requires the person to know something about the virus and the way the organism responds to it. Direct mass analysis of viruses in whole blood or fractions is possible by Applicant's invention. The whole virus can be mass isolated and identified by tandem mass spectrometry. The design and effectiveness of drugs to combat viruses or even bacteria will be much more efficiently performed and evaluated by Applicant's invention.

Biomedicine is not the only area that is affected by Applicant's invention. Nanotechnology is a burgeoning field that desperately needs new and more effective methods of analysis. The ability to evaluate the chemical activity of catalyst nanoparticles as a function of size and composition rapidly could have a profound impact on the chemical industry. Better nanocatalysts will significantly aid in promoting and enabling a hydrogen economy.

Applicant's present mass spectrometer system comprises four sections: an aerodynamic lens system that collimates the particles into a tight beam, a kinetic energy reducing jet and a variable frequency multipole (such as quadrupole, hexapole, octapole, etc.) ion guide system that slows the charged species to near zero kinetic energy at any mass-to-charge ratio (m/z) and delivers them on demand, a digital ion trap that permits instantaneous changes in the trapping potential frequency so that any mass-to-charge ratio ion can be stored, excited or ejected, and a thermal vaporization/ionization detector (charged-species detection system) that can detect any mass. Applicant's mass spectrometer system is unique in that it has an essentially unlimited mass range due to the design and operation of the components in the system. Applicant's mass spectrometer system is an ion trap-based system which operates at variable frequencies. The frequency of the trapping potential is completely and instantaneously adjustable from zero to five MHz. All commercially available ion trap mass spectrometers operate at fixed frequency. The ability to instantaneously change or sweep the trap frequency endows Applicant's mass spectrometer system with an essentially unlimited mass range $1–10^{16}$. Because Applicant's system is an ion trap-based system, it has the ability to perform tandem mass spectrometry. Moreover, Applicant's mass spectrometer system is able to perform tandem mass spectrometry (MS) at any mass. This ability permits real-time characterization, identification and possibly even sequencing of whole DNA and RNA, ultra large proteins and direct identification of viruses. Detection of the charged species expelled from the trap is done with a unique combination of thermally-induced vaporization/fragmentation coupled with electron impact ionization to charge the vaporized species. The nascent ions are detected by standard mass spectrometry detection methods such as impaction on a conversion dynode followed by detection of the oppositely charged species with a Channeltron electron multiplier detector. The nascent vapors are ionized and detected in real-time.

The equations that govern the stability of any charged species in an ion trap is given by the following equations:

$$(m/z)=8V/q_z\omega^2(r_0^2+2z_0^2)$$

Where m is the mass, z is the charge, V is the amplitude of the potential wave form, $q_z$ is the Mathieu parameter, $\omega$ is the angular frequency of the potential waveform, $r_0$ is the radial distance from the center of the trap to the ring electrode and $z_0$ is the shortest distance between the center of the trap and the end cap electrode. The Mathieu parameter $q_z$ is given by:

$$q_z=4eVz/m\omega^2r_0^2$$

In the absence of a DC component to the potential, a charged species is stable in the trap when its corresponding value of $q_z$ is between 0 and 0.908 for a sinusoidal potential.

There are three variables that effect charged species in the trap. They are the frequency, ω, the amplitude, V, and the trap size defined by $r_0$ and $z_0$. With these variables, an ion trap can be set up to trap any charge to mass ratio. (R. E. March and R. J. Hughes with an historical review by J. F. J. Todd. *Quadrupole Storage Mass Spectrometry*. Chemical Analysis Series, vol. 102. New York: John Wiley, ISBN 0-471-85794-7, Chapter 2, pp. 31–110, 1989, incorporated herein by reference).

A commercially available high voltage (field effect transistor (FET)-based) pulser is used to digitally synthesize the trapping potential with a 0–5 MHz and 0–1000 V peak to peak range. The pulser permits the continuous production of 1000-V square wave potentials up to 1.5 MHz. The same pulser can also continuously produce a 200-V potential at up to 5 MHz where the power dissipation is higher. The pulser operates under any set of conditions defined by the digital and power supply inputs below these specified limits. Because the potential is digitally generated, the frequency of the pulser can be swept, instantaneously change it or modulated. With the development of the FET-based pulsers, ion traps can now be operated by changing the frequency of the potential (Ding et. al., 2001, incorporated herein by reference). The combination of Applicant's inlet with a digital ion trap permits trapping and expelling ions over an extremely large mass range.

There are some significant advantages that digital traps have over conventional ion trap systems. For example, ions can be swept out of the trap by scanning the frequency in the forward or backward direction. Therefore, specific ions can be precisely isolated by ejecting all of the masses above and below the mass of interest in two sweeps. Digital waveform generation also permits direct modulation, alleviating the need for applying a dipolar excitation to the endcap electrodes. Ding et al. estimated the resolution of their digital ion trap from simulations. According to their work, a resolution of 13,500 could be achieved for mass 3500 Da and 2 units of charge using an unstretched trap geometry and a DC electrode to adjust the field at the end cap electrodes. Similar resolution can be achieved in the high mass region as well because the well depth during expulsion from the trap does not change when scanning the frequency. Frequency control also yields a great advantage in tandem mass spectrometry. It permits optimization of the psuedopotential well depth, $D=q_zV/8$, since $q_z$ is inversely proportional to the square of the frequency. This means that collision-induced dissociation can be performed at any value of m/z instead of only at the smaller values where the well depth is sufficient to keep the analyte ion in the trap while it is being dissociated. Optimization of the well depth also permits the extension of the number of steps that tandem mass spectrometry can be performed on an analyte by mitigating the loss of ions during the dissociation process. Consequently, performing tandem mass spectrometry over more than ten times, could become routine, no matter the m/z of analyte. This vastly increases the ability to sequence large proteins and even DNA from the "top down".

Prior to Applicant's invention, there was some question as to the ability to perform collision-induced-dissociation (CID) in the ultrahigh-mass range. Excitation at the secular frequency of ultrahigh mass-to-charge ratios might take an exceedingly long time to achieve the energy required for dissociation due to the large density of states of such large species. On the other hand, there are correspondingly more buffer gas collisions to offset the increase in the density of states. Additionally, the well depth can be maintained at a relatively high level so that a higher axial field can be applied. In the event that CID does have a mass limit, there are still other options that do not seem to be affected by the mass of the species such as photon-induced dissociation (PID). PID can readily be performed inside the trap using a pulsed laser in the UV or IR region of the spectrum. This technique has the advantage of rapid dissociation that can be used in conjunction with the ability to instantaneously change the trapping frequency. This combination of Applicant's invention allows Applicant's inventive spectrometer to look at very small fragments from a massive precursor ion. For example, using Applicant's spectrometer, if a protein complex in the MDa range is trapped and it is desired to analyze for some of the associated proteins in the 20 KDa range. Normally, it would be impossible to dislodge and trap the proteins while holding the massive complex in the trap for CID because of the limited dynamic range of the trap. However, it is possible to dissociate the precursor ion with an IR laser pulse and simultaneously switch the trapping frequency to "catch" the 20 KDa proteins and subsequently perform tandem mass spectrometry on them for the purpose of species identification. The combination of digital ion trap mass spectrometry coupled with Applicant's kinetic energy-reducing inlet, facile tandem mass spectrometry is possible because of the vast flexibility of Applicant's technique that results from the ability to optimize the potential well at any mass-to-charge ratio and instantaneously change it.

The final hurdle in performing mass spectrometry over such an extraordinary mass range $1–10^{16}$ is detection of the charged species as they are ejected from the ion trap. This is no problem for species below approximately 100 KDa. In this range, conversion dynodes work well in conjunction with some form of electron multiplier. However, above 100 KDa, (or >7 nm) the performance of these detection systems begins to degrade because charge conversion at the dynode surface requires increasing kinetic energy with increasing mass. From the other end of the mass range, detection of single particles down to 14 nm (~1 MDa) has been accomplished by another group using aerosol beam focusing and time-of-flight mass spectrometry. Applicant has observed individual 14-nm particles by catching them in an ion trap with a digitally generated field and subsequently ablating and ionizing the vaporized material. Applicant has performed the same experiment on 100-μm particles as well. Similarly, others have detected single particles by flash volatilizing particles in a hot chamber or on a heated filament and subsequently ionizing the vaporized material by electron impact followed by detection of the nascent ions at a single mass using a quadrupole mass spectrometer. In these experiments, Jayne et al. reported that ions from individual particles were produced in bursts that last tens of microseconds. They reported a detection limit for individual particles of approximately 40 nm (~10 MDa). Lui et al. successfully detected charged species down to 20 nm (~2 MDa) using only a Faraday cup. Therefore, successful detection of the ejected charged species is virtually guaranteed at some level. The important issue that Applicant addresses with the present invention is sensitivity and how to optimize it over the entire mass range.

To bridge the gap between the detection of particles and the detection of biomolecules, the individual ionic species cannot be easily laser ablated and ionized as they exit the trap. Applicant's instrument can bridge the particle/molecule detection gap between 100 KDa and 10 MDa. Applicant's instrument offers several advantages to accomplish this. First, the charge-to-mass ratio is determined as the charged species leaves the trap so that conservation of the molecular integrity is not an issue; the particle constituents are not being analyzed, only detection of the presence of the charged species. In fact, a greater degree of fragmentation provides greater sensitivity by producing a greater number of detectable charged species. Consequently, the sensitivity can be increased by increasing the filament temperature. Second, all of the ionic species created from the large molecule or particle are detected, not just a narrow mass range. Applicant's present invention will not incur losses that occur during transmission through a quadrupole mass filter. Furthermore, Applicant's present invention enhances detection capabilities in the mass range below 100 KDa as well because molecules in this range also thermally fragment to create several more ions. Therefore, thermally fragmenting and ionizing the particles/molecules as they are ejected from the trap is an effective detection method for the entire mass range $1–10^{16}$ DA.

Applicant's kinetic energy reducing inlet permits the delivery of extremely high mass charged species into vacuum with near zero translational kinetic energies. Applicant's inlet system comprises an aerodynamic lens system coupled with a reverse jet produced from an annulus and a multipole ion guide (such as a quadrupole, hexapole, octapole, etc.) operated with a digitally produced potential to maintain the collimation of the charged particles and trap them after they have been slowed down, so that they may be delivered when needed. Expansion of a carrier gas laden with particles (very large molecules or clusters of molecules) into vacuum imparts increasing amounts of translational kinetic energy into the particles as a function of increasing mass because the particles tend to acquire the velocity of the expanding gas. Consequently, the difficulty of performing mass spectrometry increases with increasing mass. This is problematic even for expansion from a relatively low pressure into vacuum. These kinetic energies make mass spectrometry difficult by ruining resolution, decreasing sensitivity and making the charged particles uncontrollable. This is true for all forms of mass spectrometry because the depicted translational kinetic energies rapidly approach and exceed the potential energies that can be applied to the charged species by the mass spectrometer for mass analysis. Reduction of the translational kinetic energy of these particles is necessary to enable mass spectrometry in the mega-dalton mass range and beyond. This is accomplished using standard aerodynamic principles. The inlet of Applicant's mass spectrometer system comprises an aerodynamic lens system that collimates the particles into a tight beam, a kinetic energy reducing device which is a reverse jet that slows charged species to near zero kinetic energy at any mass to charge ratio and delivers them on demand, and a multipole ion guide. The translational energy acquired by the particles as they exit the aerodynamic lens system can be removed with a gas expansion in the reverse direction and/or passage through a stagnant volume of gas. The degree of reduction of kinetic energy is easily controlled by either the stagnation pressure of the reverse expansion or (and) the pressure of the stagnant volume of gas, respectively. The reverse jet is created in an annulus around the particle beam axis. Applicant's inlet system can be used on any type of mass spectrometer to extend its mass range and increase its resolution in the high mass range. However, it is better used in combination with a digital ion trap.

Aerodynamic lenses produce a series of axially symmetric contractions and enlargements. When the particles encounter a constriction as they flow through the device, they move closer to the lens axis if the particle size is less than a critical value. A series of lenses with decreasing constriction sizes causes the particles over a large size range to collimate at the lens axis. Particles close to the lens axis experience small radial drag forces and therefore stay close to the axis during nozzle expansion into vacuum and form a narrow particle beam. The aerodynamic lens system 5, shown in FIG. 1, is used as part of Applicant's unique inlet to an ion trap-based ambient aerosol mass spectrometer wherein 10 is the exchangeable orifice.

Figure 2:
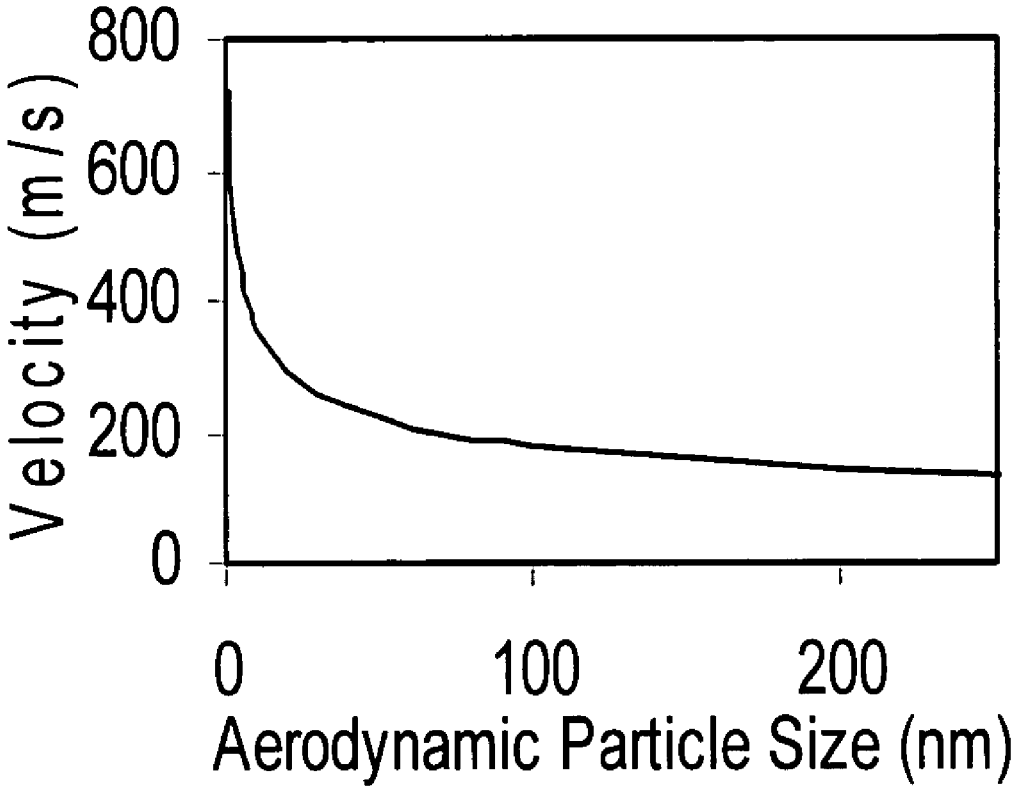
FIG. 2 shows size dependent particle velocity from an aerodynamic lens system.

The aerodynamic lens system delivers the particles into vacuum with a low pressure expansion (1–10 Torr) through the final orifice 15. The transport efficiency through the lens system is near unity for all sizes over the range of the system. FIG. 2 shows size dependent particle velocity from an aerodynamic lens system, such as that used by Applicant in FIG. 1. The lens system produces collimated beams less than 1 mm in diameter over a wide range of sizes, although the beam diameter is also somewhat particle size dependent, becoming wider for the smaller particles sizes. The radial dispersion of the particle beam during the final expansion into vacuum increases with decreasing particle size due to Brownian motion of the particles about the lens axis and lift forces associated with non-spherical particles. Unfortunately, this happens in the size regime that is most critical for biomedical research, namely diameters below 30 nm. However, with the design of Applicant's aerodynamic lens system, it is possible to compensate for many of these radial dispersive effects during the expansion by charging the particles before they enter the aerodynamic lens system and passing them through an Einsel lens system. Applicant's present invention provides for well collimated charged particle beams that deliver the particles through a relatively small area (<1 mm in diameter) with great efficiency.

Figure 3:
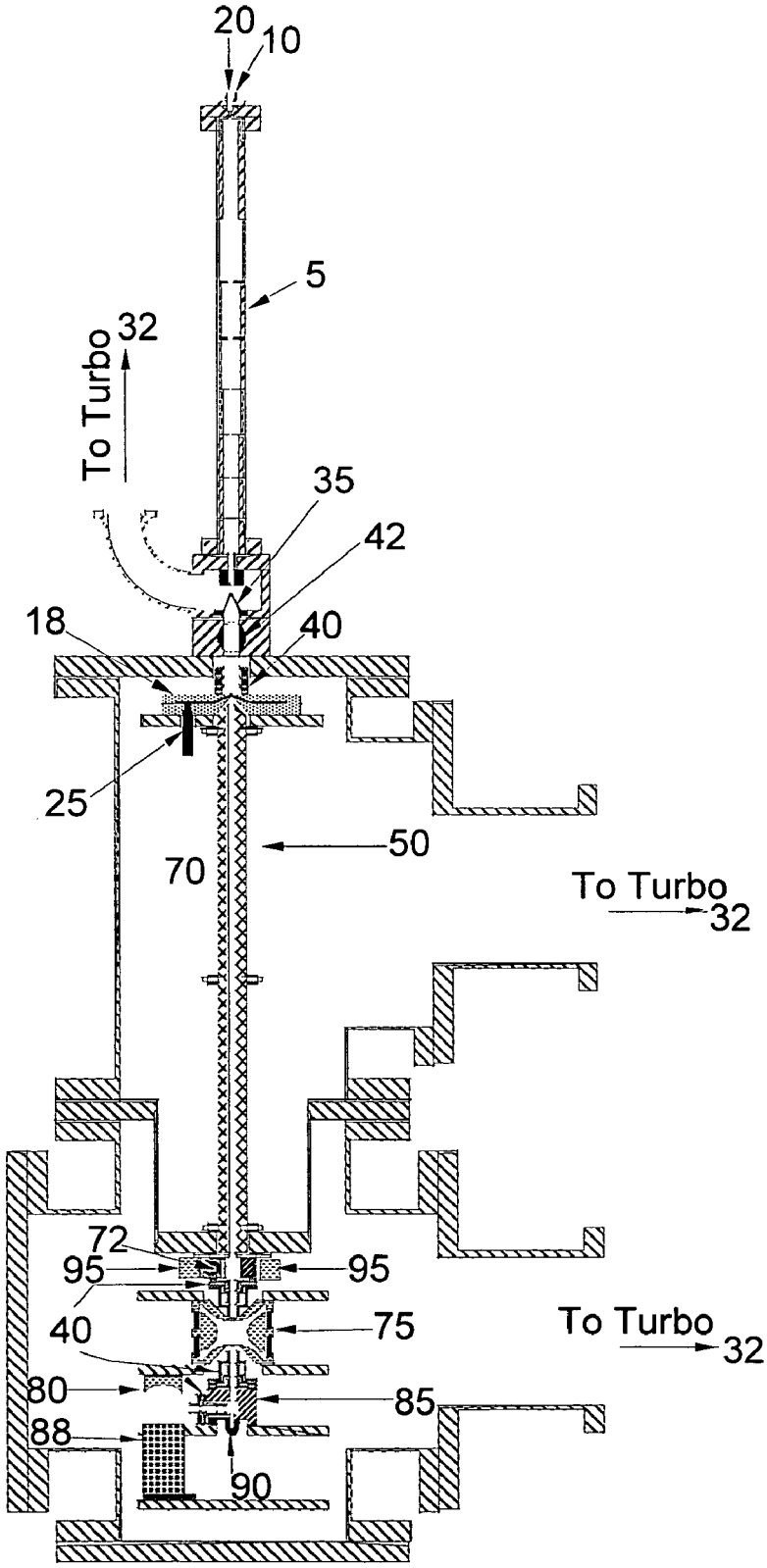
FIG. 3 is a schematic of Applicant's mass spectrometer system.
Figure 4:
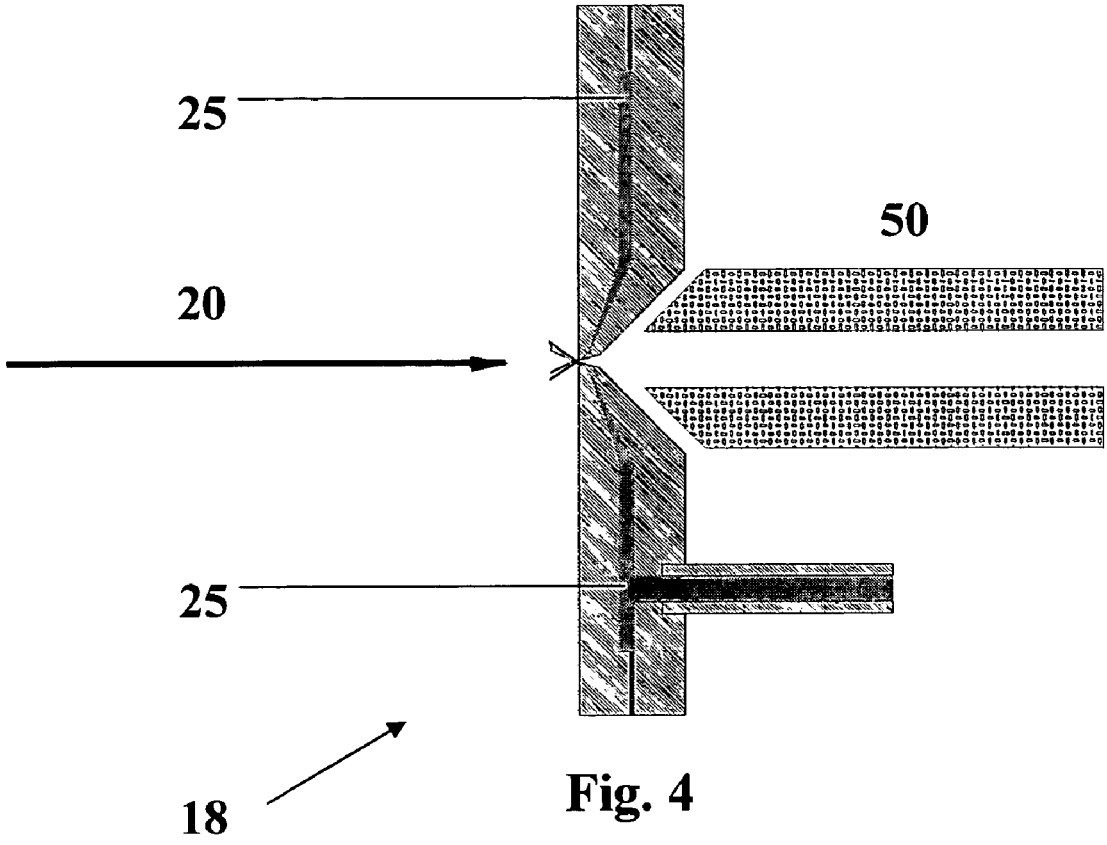
FIG. 4 is a schematic of Applicant's reverse jet and quadrupole.

In Applicant's mass spectrometer system, shown in FIG. 3, the very well collimated, mono-energetic (as a function of size) particle beam 20 is delivered from the aerodynamic lens system 5 to a reverse jet 18 within a vacuum chamber (32 depicts a vacuum pump) wherein the reverse jet of gas is generated in an annulus chamber 25 so to slow the particles down aerodynamically with a movement of gas (expansion) in the reverse direction. The schematic of the reverse jet 18 is shown in FIG. 4 wherein 20 represents the collimated particle beam (aerosol beam), 25 is the annulus chamber, and 50 is the multipole ion guide. The pressure in the annulus chamber can be adjusted with a leak valve. If the pressure in the annulus chamber is zero then the particle beam passes through the center of the jet unimpeded. If the flux out of the annulus is greater than the flux from the final expansion in the aerodynamic lens system then the aerosol beam will not pass through the reverse jet into the multipole guide. Naturally, there is an intermediate pressure regime where the particle beam is slowed yet a substantial portion passes through the jet losing forward momentum and passing into the multipole guide where they are recollimated by the multipole field. The overall pressure in the reverse jet/ion guide chamber (kinetic energy reduction chamber) 70 can be adjusted to a few millitorr to remove the residual forward momentum so that the particles can be trapped by placing a potential on the end plates of the multipole guide.

Figure 5:
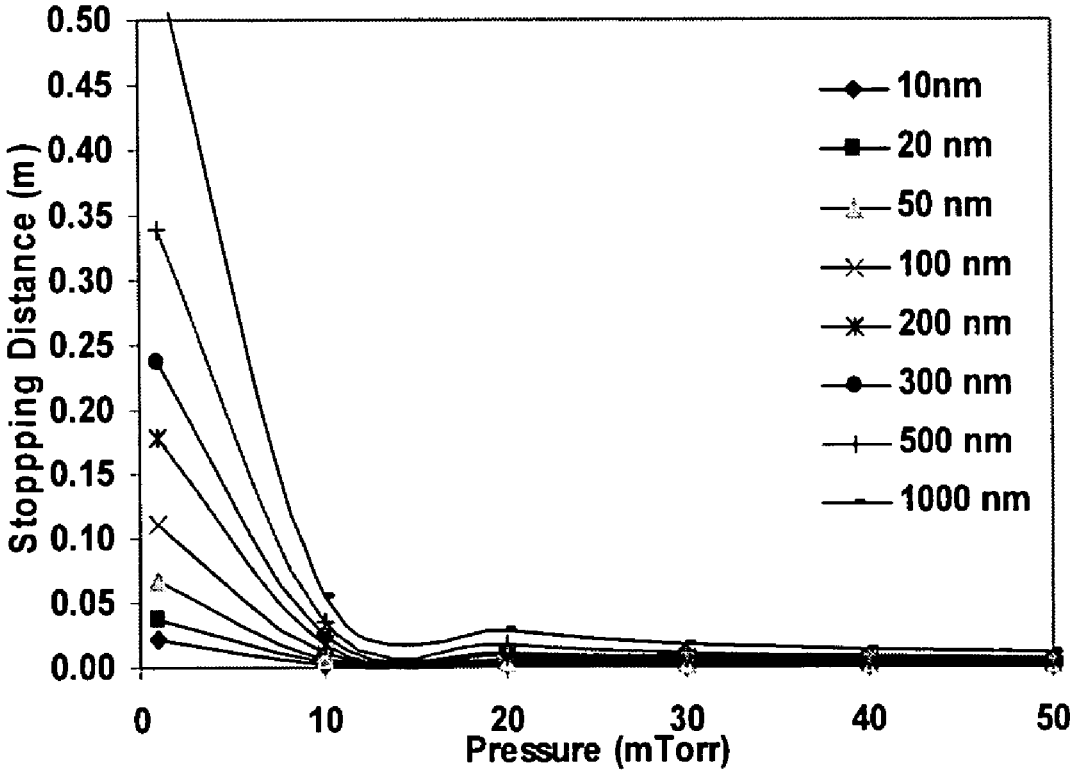
FIG. 5 shows the stopping distance for various sizes of particles exiting an aerodynamic lens system versus stagnant gas pressure.

In Applicant's mass spectrometer system, shown in FIG. 3, the reverse jet 18 sits inside a vacuum chamber in line with the collimated particle beam axis with the annulus chamber pressure on both sides of the device the same. The reverse jet 18 is formed in an annulus 25 around the particle beam axis. The expansion from the annulus moves in reverse direction only. There is no pressure drop-induced expansion in the direction of the particle beam 20. If the pressure in the annulus chamber 25 is the same as the vacuum chamber pressure there is of course no reduction in velocity. As the annulus chamber pressure is increased, the jet is formed in the reverse direction and the impinging particles are slowed down as they pass through the inner orifice. Since the pressure of the jet drops by a factor of ~1000 within approximately five nozzle diameters (~3 mm), the deceleration occurs over a very short distance in a very small volume as does the acceleration during an expansion. Because deceleration occurs so close to the orifice and the width of the particle beam is roughly the same diameter as the orifice, the slowing particles have a relatively large probability of passing through the inner orifice provided they maintain a net forward velocity. The majority of particle momentum reduction occurs within approximately 1 mm of the annulus. This means that slowed particles have a fairly large probability of making it through the center of the annulus. The deceleration of the particles can be carefully controlled by adjusting the stagnation pressure in the annulus chamber. The forward kinetic energy can be reduced to near zero for particles over the entire size range provided the acceleration and deceleration expansions are nearly matched. If the velocity of the particles is reduced by only a factor of ten, then the velocity distribution can be further reduced to a room temperature distribution by passage of the particle beam through a 1–10 mTorr stagnant gas. This can be seen in FIG. 5 where the stopping distance has been calculated for various sizes of particles exiting an aerodynamic lens system with one tenth of the velocities shown in FIG. 2 passing through a stagnant gas as a function of gas pressure. The stopping distance of a particle is defined as the distance that a particle of a specific size and velocity penetrates into a volume of gas before its forward motion is effectively stopped. These distances are calculated with the assumption that drag on the particles can be calculated using Stokes law. The reason that a pressure of 1–10 mTorr was chosen to estimate the stop distance is that this is the normal operating pressure for ion guides and traps. Maintaining the ion guides at or below this pressure permits high voltages to be used while avoiding arcing. Ion guides that are the lengths of the calculated stopping distances and more are routinely used in mass spectrometry. Placing a radiofrequency (rf) only multipole guide operating at a frequency selected for a specific size range immediately after the reverse jet keeps the charged particles collimated while they decelerate to a room temperature velocity distribution. The charged particles can be collected in the ion guides and subsequently pulsed into any type of spectrometer using DC fields in a manner similar to that used by Wilcox et. al., in 2002, to pulse ions into their ion cyclotron resonance mass spectrometer.

Figure 6:
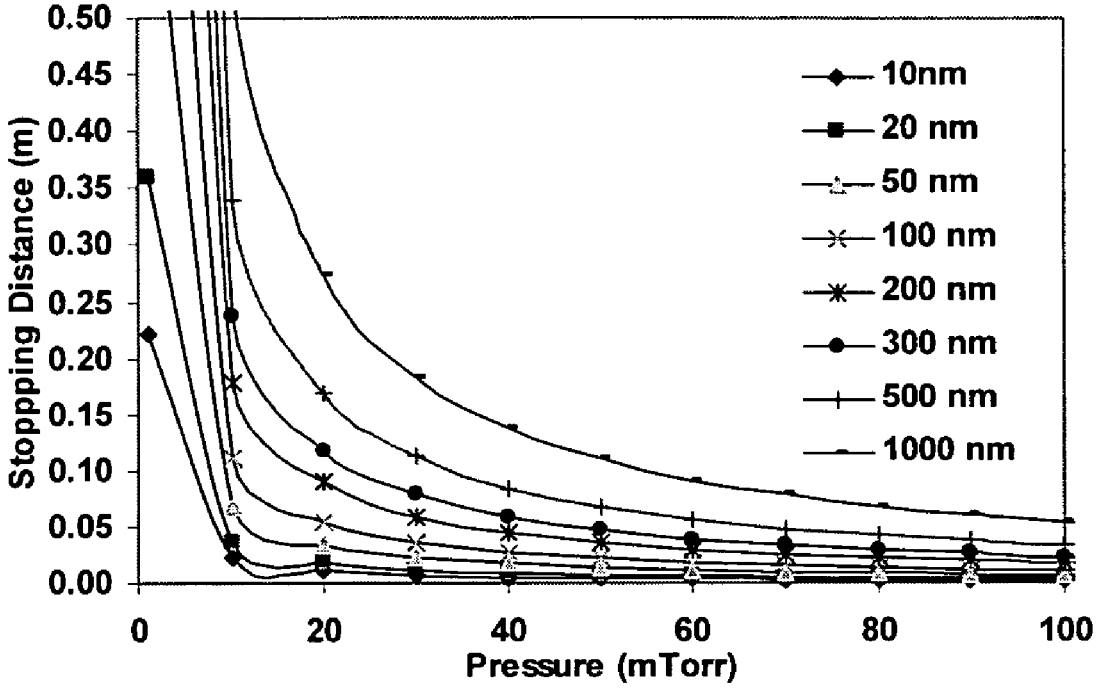
FIG. 6 shows the stopping distance for unslowed particles having a range of particle sizes exiting the aerodynamic lens system as a function of stagnant gas pressure.
Figure 7:
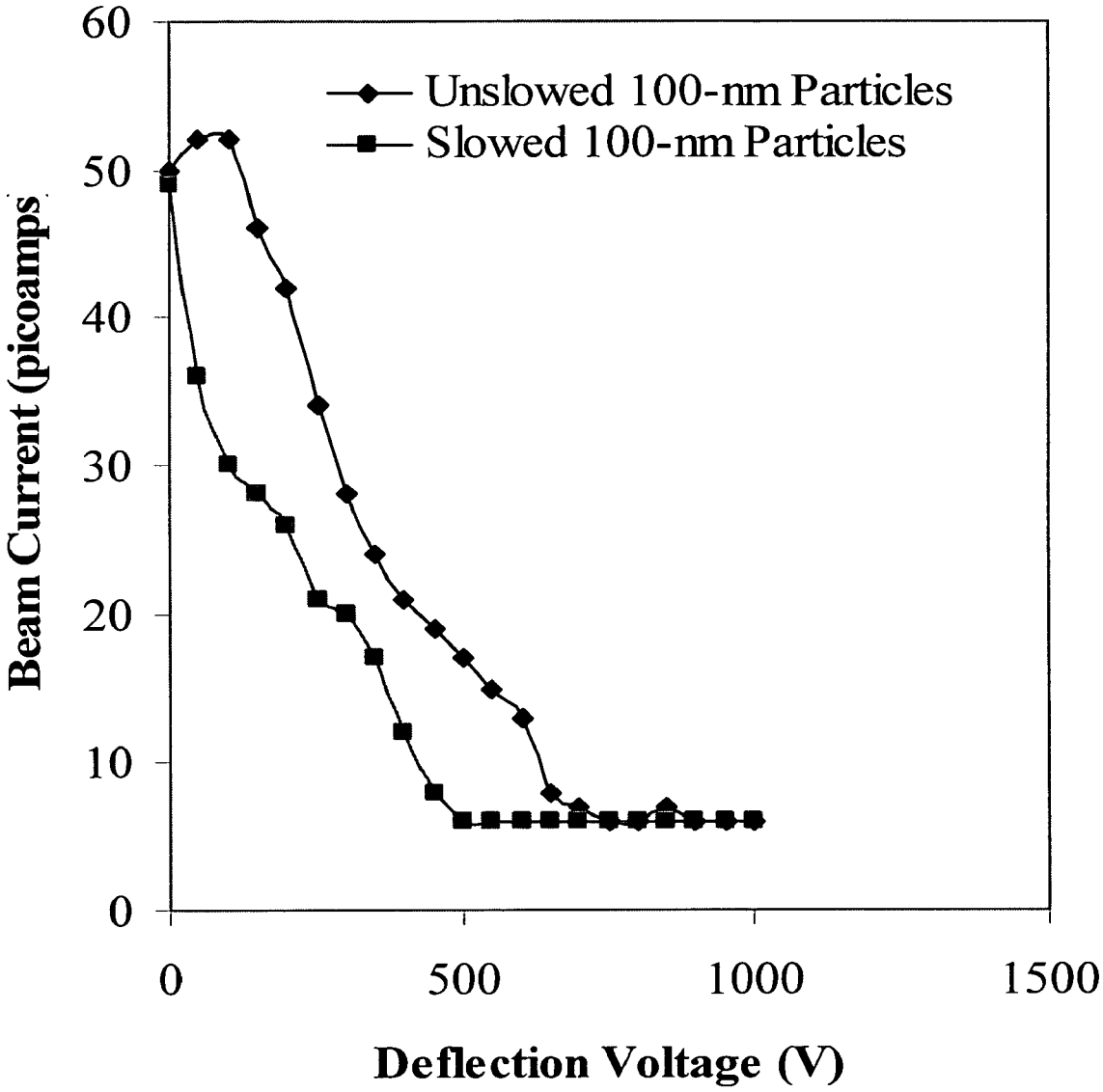
FIG. 7 shows deflection voltage versus particle beam current for reverse jet slowed and unslowed 100-nm particles.

An alternative embodiment to Applicant's invention comprises a situation wherein if the reverse jet-based inlet system, described above, is unable to deliver particles in sufficient quantities with low kinetic energies, then the particles can be slowed by passage through a stagnant gas without the use of the reverse jet. FIG. 6 presents the stopping distance for a range of particle sizes coming from an aerodynamic lens system (unslowed) as a function of stagnant gas pressure. Here, it can be seen that particles below 1000 nm in diameter can be stopped by passage through approximately 30 cm of gas at 20 mTorr. Consequently, the graph in FIG. 6 can be used to define or adjust the pressure of the guide to trap various particle size ranges. This embodiment is less advantageous than the reverse jet for stopping and trapping the particles because the mass range of what can be trapped is limited due to the pressure in the guides. Multipole ion guides have been operated at pressures of hundreds of mTorr. Therefore, multipole ion guides may be used to keep the charged particle beam collimated as it slows down. The problem with operating these devices at high pressures is that they can only be operated at a few hundred volts without arcing. Reducing the operating voltage reduces the depth of the psuedopotential well that is used to collimate the charged particle beam. Consequently, the range of particle masses that can be easily transmitted will also be decreased. In one experiment, it was seen that particles exiting the aerodynamic lens diffused less than one half a millimeter in the radial direction while moving forward 120 mm. This means that the initial radial velocity of the particles is at least 240 times less than the forward velocity. Consequently, to keep particles with $1\times10^6$ eV of translational kinetic energy collimated during deceleration, the pseudopotential well depth of a set of multipole ion guides would have to be at least eighteen volts ($>10^6/240^2=17.4$ eV). This well depth can be achieved with about 300 V on the rods. Therefore, even very energetic particles will remain collimated inside a multipole guide while being slowed by diffusing through a buffer gas. One key advantage to the reverse jet is that the same forces that give the particles their colossal kinetic energies are the same ones that take it away. Consequently, the same reverse jet conditions that slow small particles are the same as those that slow the large particles. This is proven by the data given in FIG. 7 wherein initial tests with the reverse jet and the aerodynamic lens inlet system, using a set of deflection plates and a Faraday cup verifying the viability of the reverse jet for reducing the forward velocity of the particles. FIG. 7 shows the reduction in the voltage needed to completely deflect the 100-nm particle beam from hitting the Faraday cup that occurs with the application of the reverse jet. Too vigorous an application of the jet significantly reduces the current at the Faraday cup because slowing the particles beam increases its dispersion. This figure does not represent the optimal application of the reverse jet for trapping particles in a quadrupole guide; however, it shows that it is effective at reducing the forward momentum so that they can be trapped. (Klaus Willeke and Paul Baron, *Aerosol Measurement Principles, Techniques, and Applications*, New York, N.Y., John Wiley & Sons, Chapter 3, pp. 23–40 (1993), incorporated herein by reference).

The combination of the aerodynamic lens system 5, Einsel lenses (40, FIG. 3), reverse jet 18 and variable frequency ion guide (multipole ion guide 50, FIG. 3) produces a unique atmospheric inlet that delivers charged particles with near zero kinetic energies to any mass spectrometer with essentially an unlimited particle size range. The ion guides are operated with a digitally produced potential that can operate at any frequency up to 400 KHz. Guide potentials can be generated to trap any size particle between 3 nm and 10 $\mu$m with even a single charge. Tests of Applicant's mass spectrometer system show that particles of any size and mass-to-charge ratio can be easily delivered into the ion trap on demand for mass analysis.

The inlet of Applicant's invention was characterized with commercially available monodispersed latex beads of various known sizes. These beads were nebulized, dried, charged and then admitted into the inlet. In the lower size ranges where the commercial monodispersed beads are not available (below 40 nm), poly dispersed aerosols were generated by nebulization and fed into a differential mobility analyzer that delivered singly charged monodispersed particles that are also used for characterization. Each particle size was studied separately to define the behavior and operation of the inlet at that size. An aerodynamic lens system 5 with exchangeable inlet orifices 10 was used to collimate the particle beam. Upon exiting the expansion nozzle at the end of the aerosol aerodynamic lens system, the particles passed through a skimmer 35 and into the vacuum chamber containing the reverse jet 18 and a quadrupole ion guide 50. A ball valve 42 was placed after the skimmer so that maintenance on the inlet could be performed without breaking vacuum in the reverse jet chamber. The alignment of the aerosol beam with the entrance of the reverse jet is critical to the inlet's operation so that particle beam transmission through the reverse jet 18 can be optimized. An Einsel lens system 40 was also incorporated into the system upstream of the reverse jet to decrease the dispersive effects that occurred for the smaller particle sizes.

In Applicant's mass spectrometer system in FIG. 3, the digital ion trap system 75 consists of commercial ion trap electrodes. There are Einsel lens-based-collimation optics 40 at the entrance and exit endcap electrodes. Their purpose is to focus the charged species entering and exiting the trap 75 without imparting more kinetic energy. An electron gun 72 (external to the trap) can be used for low mass range calibration. The digital ion trap chamber containing the electron gun 72 also has a gas inlet that can be used to produce charged species for chemical ionization. This provision permits the use of ion chemistry for characterization experiments such as the addition of anionic species to the ion trap for charge reduction. The trap has its own gas inlet so that the pressure just outside of the trap is substantially lower while the trap maintains an operating pressure of buffer gas ($1\times10^{-3}$ Torr He). The charged species that exit the trap are collimated with an Einsel lens system 40 to focus them into the vaporization/ionization chamber 85. Magnets 95 are also utilized.

The potentials for the digital ion trap and the multipole guides are produced with field effect transistor (FET) technology. FET-based pulsers allow the high voltage DC potentials to be turned on and off. A function generator is used to gate the pulser to produce the high voltage potential waveform. The function generator permits instantaneous changes in the frequency of the potential. Charged species are removed from the trap by sweeping or changing the trapping potential frequency. As discussed previously, a commercially available pulser permits waveform generation 1.5 MHz and 1000 V continuously. It also operates at 200 V at 5 MHz. One centimeter radius commercial trap electrodes can be used to trap and eject any charged species from 1 to $10^{16}$ Da.

Figure 8A:
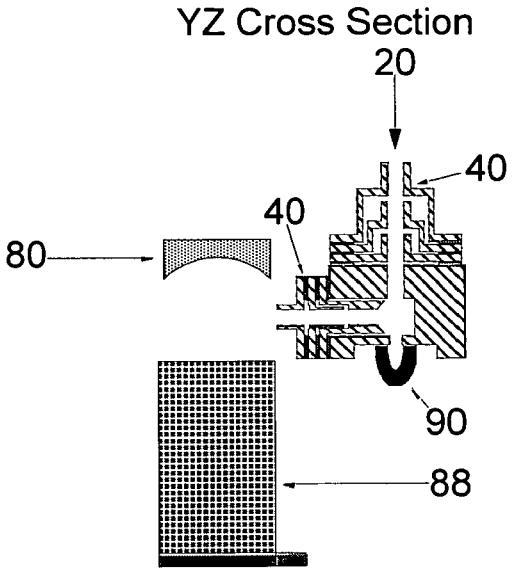
FIG. 8*a* is a YZ cross sectional view of Applicant's thermal vaporization/ionization detector system.
Figure 8B:
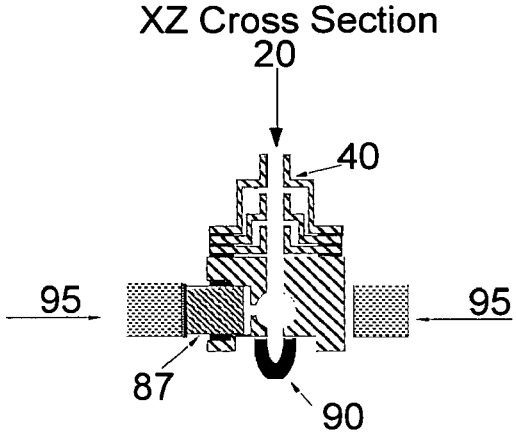
FIG. 8*b* is an XZ cross sectional view of Applicant's thermal vaporization/ionization detector system.

The design of the vaporization/ionization chamber 85 is based on particle vaporization, fragmentation, ionization and detection. FIG. 8*a* is a YZ cross sectional view of the detection system shown in FIG. 3 and FIG. 8*b* is an XZ cross sectional view of the detection system shown in FIG. 3. The particle beam 20 is further focused by a set of Einsel lenses 40 upon entering the vaporization/ionization chamber 85. The focused beam of charged species 20 ejected from the trap 75 passes through Einsel lenses 40 and into a short closed tube or cup (a closed vaporization vessel) 90 heated to high temperature (>1000° C.), by a filament where the particles rapidly vaporize and substantially fragment. The vapor plume exiting the vaporization tube 90 is further ionized by a high-current electron gun 87. The low-mass positive ions are then extracted from the vaporization/ionization chamber through another set of Einsel lenses 40, into a typical mass spectrometer detector. In this case, the detector depicted in FIG. 3 as a conversion dynode 80 and a Channeltron detector 88. Applicant's apparatus offers a single particle detection time on the order of one microsecond. Commercial ion traps scan at 150–180 $\mu$s per nominal mass unit; therefore, this detection time frame is adequate for mass scanning with an ion trap. Signal evolution is not a consideration for Applicant's system as it would be for time-of-flight mass spectrometry. The charged species are detected after they are mass analyzed by ejection from the trap therefore there is no need to limit fragmentation. Applicant's apparatus permits mass spectrometry and tandem mass spectrometry over the range of 1 to $10^{16}$ Da.

Figure 9:
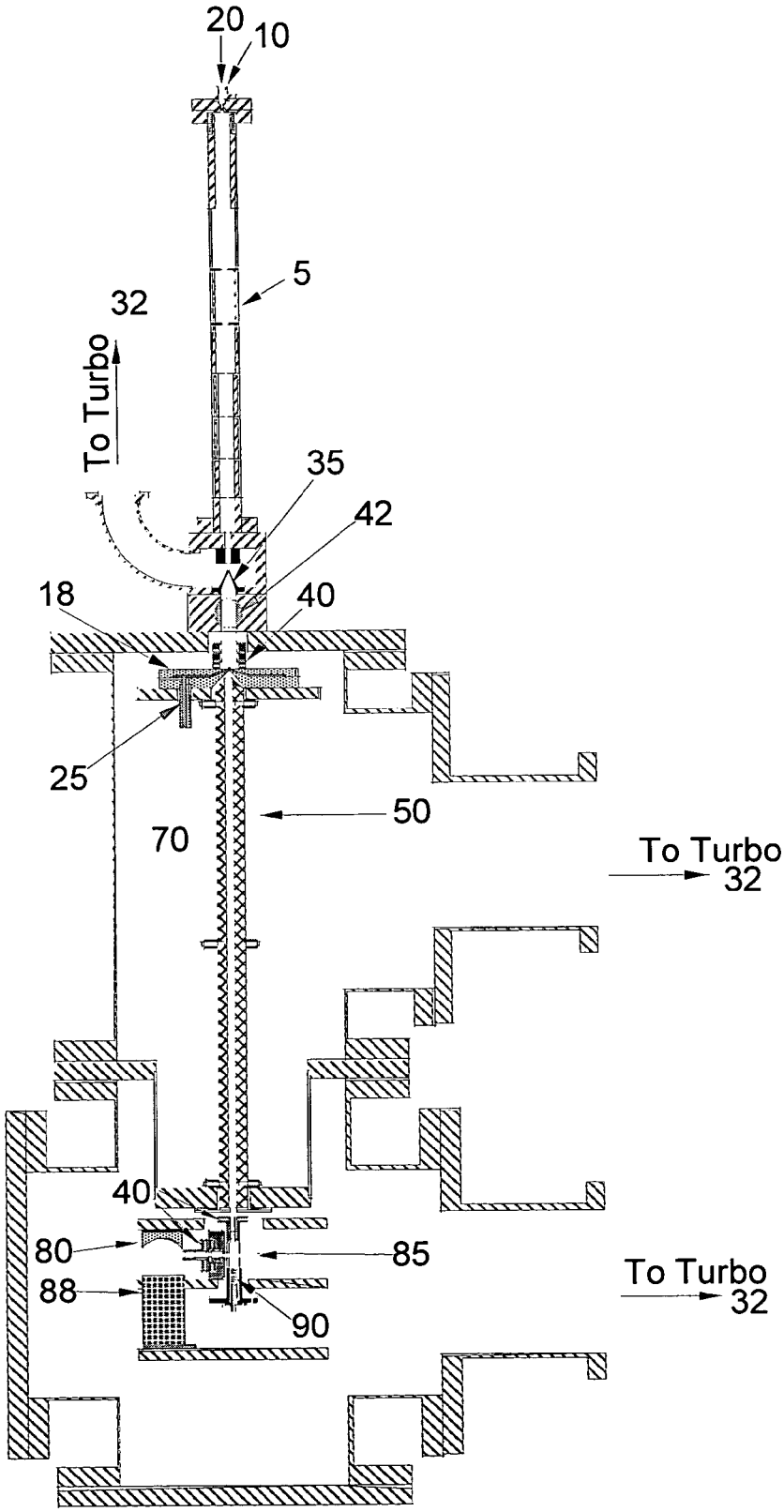
FIG. 9 is a schematic of an alternate embodiment of Applicant's mass spectrometer system using a quadrupole mass filter rather than a digital ion trap.

An additional embodiment of Applicant's invention is shown in FIG. 9 which is a schematic of an ultra high mass quadrupole mass spectrometer comprising the kinetic energy reducing inlet having the elements of an aerodynamic lens system 5, a reverse jet 18, a variable frequency multipole (such as a quadrupole) mass filter 50 and the thermal vaporization/ionization detector wherein 85 is the vaporization/ionization chamber, 90 is the vaporization tube (vessel), 80 is the conversion dynode, 40 is a set of Einsel lens and 88 is the channeltron detector. The variable frequency or digital quadrupole mass filter 50 operates in the same manner as the digital ion trap. Similarly, the mass-to-charge ratio transmitted through the mass filter is proportional to the reciprocal of the angular frequency squared. The resolution of the mass filter or the range of masses that can be transmitted through the mass filter can be adjusted by applying a DC potential across the rods. The instrument of this particular embodiment operates over the same mass range as the previously discussed embodiment of FIG. 3 having a digital ion trap; however, the embodiment of FIG. 9 cannot perform tandem mass spectrometry. Ion traps have a limited dynamic range as they cannot hold and expel widely differing masses. So, if the trap is set to trap in the million Da range, species in the billion Da range would not trap well if at all. The only way to get a true representation of the complete spectrum in that case would be to piece together the spectrum. On the other hand, the complete mass spectrum or any portion could be scanned with a quadrupole mass filter (also referred to as a quadrupole mass spectrometer (QMS)) and given an accurate representation of the ion or charged particle population. The real advantage of the embodiment of FIG. 9 over that represented in FIG. 3 is simplicity. If Tandem mass spectrometry is not needed, and that which is needed is measurement of the mass and population of the species, then QMS has an advantage of simplicity of hardware, software, and operation.

While there has been shown and described what are at present considered the preferred embodiments of the invention, it will be obvious to those skilled in the art that various changes and modifications can be made therein without departing from the scope of the invention defined by the appended claims.

What is claimed is:

1. A mass spectrometer system comprising:

a) an inlet system comprising an aerodynamic lens system for collimating particles of charged species into a beam wherein said aerodynamic lens system having a series of lenses of axially symmetric contractions and enlargements, a reverse jet for slowing said particles of charged species aerodynamically to near zero kinetic energy, and a multipole ion guide having end caps and is a variable frequency ion guide with a digitally produced potential, said multipole ion guide operating in a buffer gas to trap said particles of charged species at any mass-to-charge ratio and delivering said particles of charged species on demand, wherein said reverse jet sits in a vacuum chamber in line with the axis of said collimated beam of particles, said reverse jet coupled to said aerodynamic lens system and said multipole ion guide, said reverse jet being a gas flux generated in an annulus centered on said axis of said collimated beam of particles and propagating in the opposite direction of said beam of particles, said reverse jet having an opening through the center of said reverse jet wherein said collimated beam of particles delivered from said aerodynamic lens system passes through said center of said reverse jet wherein as said gas flux through said annulus is increased, the expansion from said annulus moves in a reverse direction forming said jet of gas in said reverse direction, wherein said gas flux through said reverse jet being adjustable to decrease the forward velocity of said beam of particles while permitting passage through the center of said annulus, said multipole ion guide coupled to said reverse jet within said vacuum chamber and in line with said axis of said collimated beam of particles, wherein the pressure in said vacuum chamber being adjustable to further slow and enable trapping of said particles in said multipole ion guide by application of a potential to said end caps of said multipole wherein said end cap potential is adjustable to permit on-demand delivery of the trapped charged particles;

b) a digital ion trap that permits instantaneous changes in the trapping potential frequency so that any mass-to-charge ratio ion can be stored, excited or ejected; and c) a thermal vaporization/ionization detector system comprising a vaporization/ionization chamber for receiving said beam of charged particles, a vaporization means for thermally inducing vaporization and fragmentation of said charged particles housed within said vaporization/ionization chamber, an ionization means for ionizing the vapors from said charged particles housed within said vaporization/ionization chamber wherein said ionization means is normal to the axis of said beam of charged particles, and a detection component for detecting said charged species from the vaporized particles, wherein said ionization means is normal to the axis of said detection component.

2. The mass spectrometer system of claim 1 wherein said mass spectrometer system operates in a mass range of $1–10^{16}$ Da.

3. The mass spectrometer system of claim 1 wherein said system is capable of performing tandem mass spectrometry.

4. The mass spectrometer system of claim 1 wherein said detection component is a channeltron electron multiplier detector.

5. The mass spectrometer system of claim 1 wherein said ionization means housed within said vaporization/ionization chamber is a high-current electron gun.

6. The mass spectrometer system of claim 1 wherein said thermal vaporization/ionization detector system further comprises a conversion dynode.

7. A quadrupole mass spectrometer comprising:

a) an inlet system comprising an aerodynamic lens system for collimating particles of charged species into a beam wherein said aerodynamic lens system having a series of lenses of axially symmetric contractions and enlargements, a reverse jet for slowing said particles of charged species aerodynamically to near zero kinetic energy, and a quadrupole mass filter having end caps and is a variable frequency quadrupole mass filter with a digitally produced potential, said quadrupole mass filter operating in a buffer gas to trap said particles of charged species at any mass-to-charge ratio and delivering said particles of charged species on demand, wherein said reverse jet sits in a vacuum chamber in line with the axis of said collimated beam of particles, said reverse jet coupled to said aerodynamic lens system and said quadrupole mass filter, said reverse jet being a gas flux generated in an annulus centered on said axis of said collimated beam of particles and propagating in the opposite direction of said beam of particles, said reverse jet having an opening through the center of said reverse jet wherein said collimated beam of particles delivered from said aerodynamic lens system passes through said center of said reverse jet wherein as said gas flux through said annulus is increased, the expansion from said annulus moves in a reverse direction forming a jet of gas in said reverse direction, wherein said gas flux through said reverse jet being adjustable to decrease the forward velocity of said beam of particles while permitting passage through the center of said annulus, said quadrupole mass filter coupled to said reverse jet within said vacuum chamber and in line with said axis of said collimated beam of particles, wherein the pressure in said vacuum chamber being adjustable to further slow and enable trapping of said particles in said quadrupole mass filter by application of a potential to said end caps of said quadrupole mass filter wherein said end cap potential is adjustable to permit on-demand delivery of the trapped charged particles;

b) a thermal vaporization/ionization detector system comprising a vaporization/ionization chamber for receiving said beam of particles of charged species, a vaporization means for thermally inducing vaporization and fragmentation of said charged particles housed within said vaporization/ionization chamber, an ionization means for ionizing the vapors from said charged particles housed within said vaporization/ionization chamber wherein said ionization means is normal to the axis of said beam of charged particles, and a detection component for detecting said charged species from the vaporized particles, wherein said ionization means is normal to the axis of said detection component.

8. The quadrupole mass spectrometer system of claim 7 wherein said system operates in a mass range of $1–10^{16}$ Da.

9. The quadrupole mass spectrometer system of claim 7 wherein said detection component is a channeltron electron multiplier detector.

10. The quadrupole mass spectrometer system of claim 7 wherein said ionization means housed within said vaporization/ionization chamber is a high-current electron gun.

11. The quadrupole mass spectrometer system of claim 7 wherein said thermal vaporization/ionization detector system further comprises a conversion dynode.

12. An inlet system for use with a mass spectrometer system comprising:

a) an aerodynamic lens system for collimating particles into a beam, comprising a series of lenses of axially symmetric contractions and enlargements;

b) a reverse jet for slowing said particles of charged species aerodynamically to near zero kinetic energy at any mass-to-charge ratio and delivering said charged particles on demand, wherein said reverse jet sits in a vacuum chamber in line with the axis of said collimated beam of particles, said reverse jet coupled to said aerodynamic lens system, said reverse jet being a gas flux generated in an annulus centered on said axis of said collimated beam of particles and propagating in the opposite direction of said beam of particles, said reverse jet having an opening through the center of said reverse jet wherein said collimated beam of particles delivered from said aerodynamic lens system passes through said center of said reverse jet wherein as said gas flux through said annulus is increased, the expansion from said annulus moves in a reverse direction forming a jet of gas in said reverse direction, wherein said gas flux through said reverse jet being adjustable to decrease the forward velocity of said beam of particles while permitting passage through the center of said annulus; and c) a multipole ion guide having end caps and is a variable frequency ion guide with a digitally produced potential wherein said multipole ion guide is coupled to said reverse jet within said vacuum chamber and is in line with said axis of said collimated beam of particles, wherein the pressure in said vacuum chamber being adjustable to further slow and enable trapping of said particles in said multipole ion guide by application of a potential to said end caps of said multipole ion guide wherein said end cap potential is adjustable to permit on-demand delivery of the trapped charged particles.

13. The inlet of claim 12 wherein said inlet enables mass spectrometry of charged particles in a broad mass range from 1 to $10^{16}$ Da.

14. A method for slowing energetic particles using the inlet system of claim 12 comprising the steps of:

a) passing a beam of particles through an aerodynamic lens system to collimate said particles into a beam wherein said particles acquire translational energy upon exiting said aerodynamic lens system;

b) delivering said beam of particles into a reverse jet wherein said particles pass through said annulus wherein the expansion of gas in said annulus is in the reverse direction thereby slowing said particles upon entering said multipole ion guide.

* * * * *